United States Patent [19]

Woodland

[11] Patent Number: 4,931,026

[45] Date of Patent: Jun. 5, 1990

[54] JET PROPELLER

[76] Inventor: Sylvester L. Woodland, 975 McKinley Dr., Blackfoot, Id. 83221

[21] Appl. No.: 342,337

[22] Filed: Apr. 24, 1989

[51] Int. Cl.[5] ..... B63H 1/26

[52] U.S. Cl. ..... 440/38; 440/49; 60/221; 416/193 R; 416/93 R

[58] Field of Search ..... 440/38, 44, 45, 49; 60/221; 416/93 R, 93 A, 175, 193 R, 203, 93 M

[56] References Cited

U.S. PATENT DOCUMENTS

| | | | |
|---|---|---|---|
| 2,076,428 | 4/1937 | Drudy et al. | 440/44 |
| 3,102,506 | 9/1963 | Kiekhaefer | 416/93 M |
| 3,598,080 | 8/1971 | Shields | 440/38 |
| 4,050,849 | 9/1977 | Sheets | 60/221 |
| 4,150,301 | 4/1979 | Bergey | 416/193 R |
| 4,623,299 | 11/1986 | Grim | 416/175 |
| 4,834,683 | 5/1989 | Govan | 440/49 |

*Primary Examiner*—Sherman D. Basinger
*Assistant Examiner*—Stephen P. Avila
*Attorney, Agent, or Firm*—Warren F. B. Lindsley

[57] ABSTRACT

A jet propulsion engine submergible in water for driving a water craft wherein a drive shaft is connected to an internal combustion engine for rotation thereof. A first turbine is mounted on the drive shaft for rotation therewith for providing a first high velocity stream of water axially through the propulsion engine. A propeller is journalled on the drive shaft adjacent to and downstream of the first turbine for rotation independently of the drive shaft. A second turbine is mounted on the drive shaft adjacent to and downstream of the propeller for rotation therewith for generating a second high velocity stream of water axially through the propulsion engine. The speed of the propulsion engine increases through the effects of the first and second high velocity streams of water for driving the water craft while the propeller becomes less effective until it is rendered free wheeling at cruising speeds of the water craft.

8 Claims, 2 Drawing Sheets

JET PROPELLER

BACKGROUND OF THE INVENTION

Propeller type marine propulsion systems have been in use for many years, dating back to the earliest steam driven ships. Throughout its long history, the propeller or screw configuration has undergone successive improvements in the interest of better performance and higher operating efficiencies. After all such improvements, however, the direct drive propeller remains a less than optimum propulsion means.

The major problem with the propeller drive is that high operating efficiency and optimum performance can only be achieved over a narrow range of operating conditions. For example, a propeller that is designed with a low pitch and large blades will serve well to propel a tug boat with its heavy loads at low speeds. But for a pleasure boat or a speed boat a smaller propeller with a higher pitch is needed. In nearly every case, the propeller design is a compromise, with trade-offs and sacrifices in performance or efficiency at both ends of the operating range. At startup from a dead-in-the-water condition, a large short-pitch propeller is desired, while for cruising at high speed a longer pitch and a smaller propeller length is indicated. The solution is typically somewhere in between too short a pitch and too small a propeller at start-up and too long a pitch and too large a propeller for cruising. Racking the engine at start-up can readily produce cavitation which significantly reduces thrust and results in excessive fuel use. The slow forward motion of the craft at start-up with the attendant low head pressure accounts for such cavitation. At cruising speeds, on the other hand, the increased availability of water to the propeller and the resulting increased pressure under this condition could readily supply a propeller with a longer pitch and a higher drive capability.

The jet or turbine drive has been applied to speed boats with remarkable success in terms of performance. High acceleration at low speeds as well as high power at high speeds are readily achieved in such drives, but at the expense of low operating efficiencies.

Similar problems have been encountered in connection with aircraft propulsion systems. In the conversion from propeller drives to jet engines it soon became apparent that the jet engine in its simplest form was not as fuel efficient as it needed to be, especially when fuel costs began to rise during the early stages of the energy crises.

The high exhaust velocity of the jet engine accounts for its inefficiency. More thrust is obtained from a large mass of relatively slow moving air than from a smaller stream of fast-moving air.

Engine designers have found various answers to these problems in the form of turbofan or fanjet engines in which the fans normally used for compression are enlarged to supply additional air that bypasses the combustion engine and then mixes with the exhaust gases to form an enlarged exhaust stream. Considerably higher operating efficiencies have been obtained in this way. More recently, further improvements have been realized using combinations of turbines and turbine-driven propellers. Examples are the propfans and, in particular, the unducted fan produced by the General Electric Company.

Similar innovations are needed in the art of marine propulsion systems if a truly universal drive is to be achieved with both high efficiency and high performance over a wide range of operating conditions.

SUMMARY OF THE INVENTION

In accordance with the invention claimed, an improved marine propulsion mechanism is provided in the form of a jet propeller comprising a jet propulsion engine in combination with a propeller that is driven by the high velocity stream of water produced by the jet engine.

It is, therefore, an object of this invention to provide an improved propulsion drive for a marine craft such as a boat operated for commercial and pleasure purposes.

Another object of the present invention is to provide such a propulsion drive in a form that will exhibit improved performance and higher fuel efficiencies than the present propeller or turbine drives over a wide range of operating conditions.

A further object of this invention is to provide improved performance in such a drive, specifically in terms of its capability to deliver high torque and high power at low speeds as well as at full speed and, at the same time to operate under both conditions at high levels of fuel efficiency.

A still further object of this invention is to provide such improved performance through the use of a fluid drive mechanism which, in effect, serves as a means for changing the mechanical advantage or apparent gear ratio as appropriate when moving between low and high speeds.

A still further object of this invention is to achieve such improved performance and efficiency by combining propeller and turbine drives and thereby taking advantage of the best features and characteristics of each type of drive.

A still further object of this invention is to provide further improvements in the efficiency and performance of the jet propeller through the use of ventilating ports at appropriate locations.

A still further object of this invention is to provide such an improved propulsion drive in a form that is inherently inexpensive to produce since it requires a minimum of closely dimensioned parts and mechanisms requiring little machine operations.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
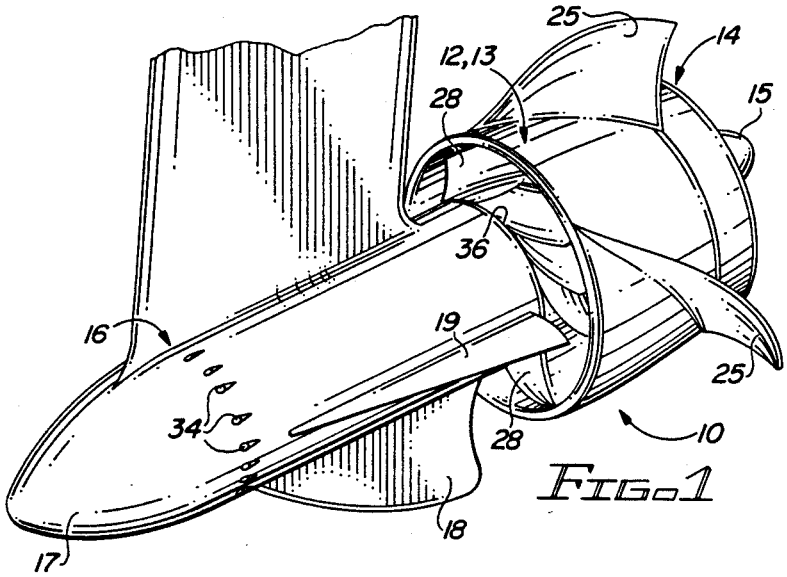
FIG. 1 is a perspective view of an improved propulsion drive or jet prop embodying the invention.
Figure 2:
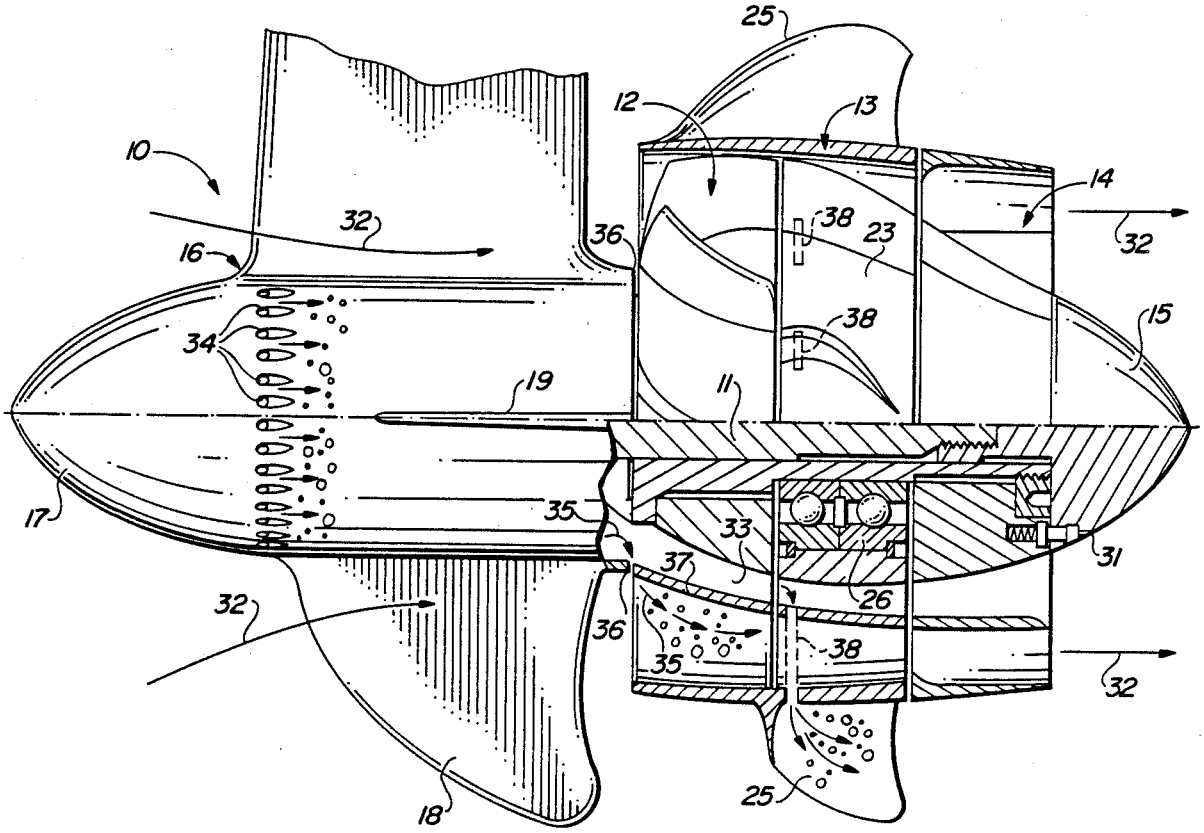
FIG. 2 is a an enlarged partially cut-away side view of the propulsion drive of FIG. 1 showing the incorporation therein of ventilating ports.

Referring more particularly to the drawings by characters of reference, FIGS. 1 and 2 illustrate an improved propulsion drive or jet propeller 10 comprising an ordinary marine right angles drive shaft 11, a primary axial turbine drive means or pump 12, a reaction propeller drive means or drive stage 13, a secondary axial turbine drive means or pump 14, and an end fastener or cap 15.

Drive shaft 11 is arranged in the usual manner for coupling an above board or outboard gasoline engine (not shown) to a submerged propeller drive at the aft end of a boat. Shaft 11 is coupled to the engine by suitable gear mechanisms enclosed in a housing 16. The housing has a parabolic nose 17 that is directed forward in the direction of travel through the water. A rudder 18 projects downward from housing 16 with horizontal fins 19 mounted on housing 16 providing vertical stability.

Axial pump 12 has a number of short fins with spiralled contours affording a relatively long pitch for driving a stream of water at high velocity. An axial opening 20 at its center is suitably grooved and dimensioned to engage splines 21 of shaft 11.

Axial pump 14 is substantially identical to pump 12 except that it carries an integral generally cylindrical shell 22 secured to the tips of its fins.

Reaction drive stage 13 comprises a reaction drive turbine 23 enclosed in a cylindrical cowling or shell 24. Shell 24 serves as the hub for three large propeller blades 25 and extends forwardly beyond the end of turbine 23 to form an enclosure for turbine 12. Turbine 23, shell 24 and blades 25 comprise an integral unit that is carried by tandem bearings 26 axially mounted in turbine 23. Bearings 26 are adapted to be mounted on shaft 11 and provide for rotational freedom for driven stage 13 about shaft 11.

Reaction drive turbine 23 is similar to turbine 12 and 14 but its fins 27 are spiralled in an opposite direction to fins 28 of axial turbine pumps 12 and 14 so that the stream of water supplied by turbines 12 and 14 will drive turbine 23 in the same direction that turbines 12 and 14 are driven by shaft 11.

Cap 15 is cone-shaped or more nearly parabolic, its form being intended to reduce drag on the high velocity stream of water that flows over it. It has internal threads that mate with threaded end 29 of shaft 11.

The assembly of jet propeller 10, as may be apparent from a comparison of FIGS. 1 and 2, proceeds as follows: axial pump 12 is first installed over the splined body of shaft 11 and moved into position against housing 16. Drive stage 13 is then installed over shaft 11 and is moved into position against pump 12, the extending end of shell 24 moving over and enclosing pump 12. Axial pump 14 is then installed over shaft 11 and is moved into position against drive stage 13. Finally cap 15 is threaded into place over the end of shaft 11 and is further secured by a spring loaded pin that is carried in an opening 31 in cap 15. The pin engages hub 11 and prevents cap 15 from turning loose.

The jet propeller operates in the following manner: The marine engine (outboard engine) turns shaft 11 and with it axial pumps 12 and 14. Pumps 12 and 14 draw a high-velocity stream of water 32 as shown in FIG. 2, from the lake, river or ocean with water 32 passing through reaction drive turbine 23, causing turbine 23 to rotate upon its bearings 26 in the same direction as but at a lower rotational velocity than pumps 12 and 14. Propulsion is provided by jet stream 32. and also by blades 25 that are integral with reaction drive turbine 23.

The water stream produced by pumps 12 and 14 as it impinges upon the fins of reaction drive turbine 23 contributes a portion of its energy to turbine 23 as turbine 23 supplies the torque to drive propeller blades 25. The relatively axial or linear flow of the stream of water produced by pump 12 is deflected to a radial somewhat tangential direction by its interaction with reaction turbine 23. Because the radial flow produces little forward thrust, secondary pump 14 is incorporated to redirect the flow pattern toward a linear or axial direction of flow through the jet propeller for effective propulsion from jet stream 32 as it leaves jet propeller 10.

The general arrangement of the primary and secondary turbine pumps 12 and 14, respectively, and reaction drive turbine 23 is similar to corresponding elements of a hydraulic torque converter. The chart shown in FIG. 4 is illustrative of the characteristics of such a torque converter and of the pump and reaction drive arrangement of jet propeller 10 of this invention.

Figures 3, 4:
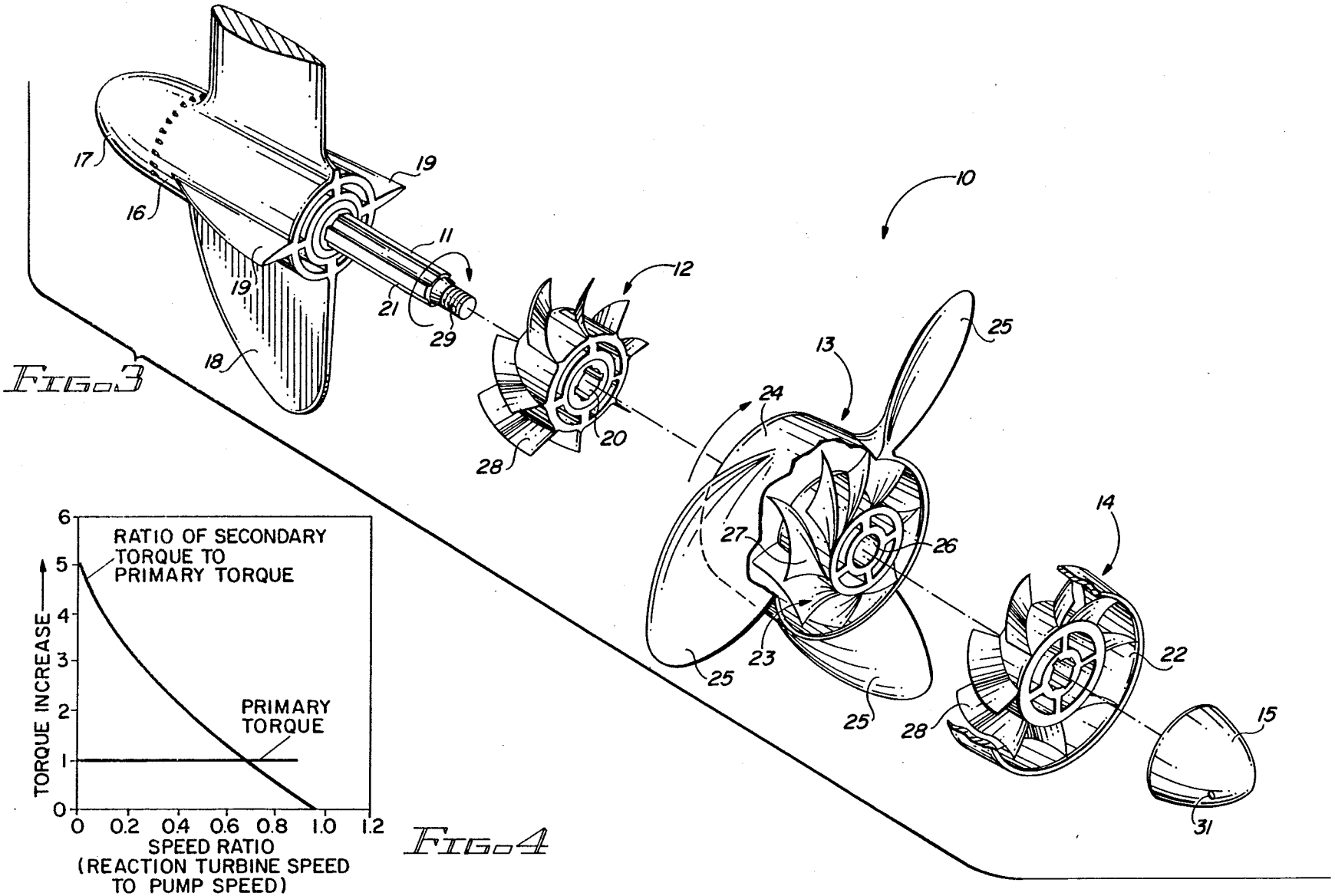
FIG. 3 is an exploded side view of the jet propeller shown in FIG. 1.
FIG. 4 is a chart showing torque and efficiency as functions of the relative angular velocities of key elements of the propulsion drive of the invention.

As shown in FIG. 4, the ratio of secondary torque (reaction torque) to primary (pump) torque varies inversely with the ratio of reaction element speed to primary (turbine pump) speed. As the speed ratio approaches unity, the reaction element torque drops sharply toward zero.

The indicated characteristics are particularly desirable in the case of the marine drive propulsion means of this invention. At start-up from the dead-in-the-water condition, the reaction drive stage 13 has a very low rotational velocity relative to the rotational velocity of turbine pumps 12 and 14. A large portion of the total energy imparted to water stream 32 by pumps 12 and 14 is thus transferred to reaction turbine 23 to be supplied at high torque to large propeller blades 25. The jet stream provides additional thrust at this time, permitting a fast take-off from a dead start. The loss of energy from stream 32 to reaction turbine 23 results in a reduced flow rate through pumps 12 and 14 and hence in a reduced water demand which is particularly lacking at start-up and at low forward speeds. At the same time, a major part of the energy delivered by the combustion engine is supplied to the reaction drive stage with its large low pitch blades 25 which are especially effective under these conditions. As forward speed increases the availability of water and head pressure increases and reaction torque decreases, but the jet stream from pumps 12 and 14 becomes increasingly effective in propelling the craft. As this occurs, blades 25 tend to be driven by the passing stream of water until at cruising velocities reaction stage 13 is almost totally free-wheeling while pumps 12 and 14 supply nearly all the drive through jet stream 32.

The result is a propulsion means that exhibits the high torque and efficiency of a propeller drive optimized at low speeds converting gradually as forward velocity increases to a jet drive tailored for high performance and efficiency at cruising speeds. A propulsion drive with good to excellent performance and efficiency over the full range of operating conditions is thus achieved.

A further enhancement of the performance of propulsion drive 10 is achieved through the incorporation of ventilating ports at judiciously selected locations in the structure. Ventilating ports have been employed in the prior art to reduce cavitation which is always present to some degree.

Cavitation is the loss of pressure that occurs at the surface of a propeller operating in either air or water when the air or water demand is not met by the supply. This condition is most severe severe at low forward speeds and low head pressures because the supply is low.

Ventilation entails the supply of air or gas by some means to the cavitating areas. The result is increased pressure at the affected surfaces. The increased pressure provides "bite" for the propeller or turbine blades, thereby reducing the deleterious effects of cavitation.

As shown in FIG. 3 ventilation is provided at three locations. The ventilating medium in this case is exhaust gas from the above board combustion engine that is channeled down through housing 16 of the right angle drive shaft 11 into an exhaust manifold 33 which passes through the interiors of pumps 12 and 14 and turbine 23 to be exhausted with water stream 32.

A first set of ventilating ports 34 is located about parabolic nose 17 of shaft housing 16. Ports 34 are most effective at high cruising speeds where the forward velocity of the craft tends to produce cavitation about nose 17, the cavitation reducing the availability of water at high speeds where an abundant supply of water is needed most.

A second location at which ventilation is provided is at the leading edge of primary pump 12 where ventilating gas 35 passes through a radial clearance opening 36 between cylindrical shell 37 of pump 12 and adjacent housing 16 of drive shaft 11. Ventilation at this point is believed to be effective in reducing drag as well as improving the water supply to the pumps.

A third location at which ventilation is provided is at the surfaces of the reaction drive propeller blades 25 where cavitation can occur at start-up. Ventilating channels 38 are provided for this purpose with channels 38 leading from manifold 33 to blades 25.

Optimization of these ventilating means is achieved through the performance of tests in which water flow patterns are observed under conditions at which cavitation becomes a problem or concern.

An improved propulsion drive or jet propeller is thus provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. A marine propulsion mechanism submergible in water for driving a water craft comprising in combination;

a drive shaft, means for connecting said drive shaft to an internal combustion engine for rotation thereof, a first turbine means mounted on said drive shaft for rotation therewith for providing a first high velocity stream of water axially through the propulsion mechanism, a propeller means journalled on said drive shaft adjacent to and downstream of said first turbine means for rotation independently of said drive shaft, a second turbine means mounted on said drive shaft adjacent to and downstream of said propeller means for rotation therewith for generating a second high velocity stream of water axially through the propulsion mechanism, said first and second streams of water causing a further resulting stream of water for impacting on said propeller means and causing it to rotate in the same direction as, but at a lower rotational velocity, then, the rotation of the first and second turbine means, said resulting stream of water aiding in creating the initial thrust of said propulsion mechanism, whereby as the speed of said propulsion mechanism increases through the effects of the first and second high velocity streams of water for driving the water craft, the propeller means becomes less effective until it is rendered free wheeling at cruising speeds of the water craft.

2. The marine propulsion mechanism set forth in claim 1 wherein:

the first and second turbine means each comprise a pump actuated by said drive shaft.

3. The marine propulsion mechanism set forth in claim 1 wherein:

said propeller means comprises a cowling, and said first turbine means fits inside of said cowling.

4. The marine propulsion mechanism set forth in claim 3 wherein:

said propeller means further comprises a plurality of blades extending laterally outwardly of said cowling for receiving the impact force of said resulting stream of water.

5. The marine propulsion mechanism set forth in claim 1 wherein:

said propeller means further comprises a third turbine drive journalled on said shaft for rotation independently thereof and rotated by said first high velocity stream of water.

6. The marine propulsion mechanism set forth in claim 3 wherein:

said propeller means further comprises a third turbine means journalled on said shaft for rotation independently thereof and mounted within said cowling, said third turbine means being rotated by said first high velocity stream of water.

7. The marine propulsion mechanism set forth in claim 1 in further combination with:

a housing for surrounding said means for connecting said drive shaft to the internal combustion engine, a plurality of ventilation ports formed in said cowling, and means for channeling through said housing and out of said ventilating ports exhaust gases from the engine to relieve the effects of cavitation internally of said propulsion mechanism.

8. The marine propulsion mechanism set forth in claim 7 wherein:

some of said ventilating ports are formed in said housing.

* * * * *

UNITED STATES PATENT OFFICE

CERTIFICATE OF CORRECTION

Patent No. 4,931,026 Dated June 5, 1990

Inventor(s) Sylvester L. Woodland

It is certified that error appears in the above-identified patent and that said Letters Patent is hereby corrected as shown below:

Claim 1, line 22, after "velocity" delete "then" and substitute ---than---.

Claim 7, line 5, after "of" delete "ventilation" and substitute ---ventilating---.

Signed and Sealed this

Sixteenth Day of July, 1991

*Attest:*

HARRY F. MANBECK, JR.

*Attesting Officer*

*Commissioner of Patents and Trademarks*